US005949322A

United States Patent [19]

Radbruch et al.

[11] Patent Number: 5,949,322

[45] Date of Patent: Sep. 7, 1999

[54] SWITCH PROTECTING AGAINST INCREASED TEMPERATURES

[76] Inventors: Jens Radbruch, Am Wolfsbaum 73, 75245 Neulingen, Germany; Udo Witteck, Im Hasenacker 11, 75181 Pforzheim, Germany

[21] Appl. No.: 08/616,221

[22] Filed: Mar. 15, 1996

[30] Foreign Application Priority Data

Mar. 17, 1995 [DE] Germany ..... 195 09 656

[51] Int. Cl.[6] ..... H01H 61/00; H01H 37/00

[52] U.S. Cl. ..... 337/89; 337/343; 337/14; 337/380

[58] Field of Search ..... 337/14, 53, 89, 337/343, 362, 365, 369, 370, 380, 408; 361/23, 24

[56] References Cited

U.S. PATENT DOCUMENTS

| | | | |
|---|---|---|---|
| 3,431,526 | 3/1969 | Amber et al. | 337/89 |
| 3,747,208 | 7/1973 | Rattan | 29/622 |
| 4,317,097 | 2/1982 | Hofsass | 337/89 |
| 4,866,408 | 9/1989 | Petraitis et al. | 337/104 |

FOREIGN PATENT DOCUMENTS

De. 1 590 660 4/1974 Germany .

OTHER PUBLICATIONS

"Klixon on Winding Motor Protectors 9700 Series" Texas Instruments Holland B.V., Apr. 1979.

*Primary Examiner*—Leo P. Picard
*Assistant Examiner*—Jayprakash N. Gandhi
*Attorney, Agent, or Firm*—Horst M. Kasper

[57] ABSTRACT

An flat casing (10) exhibiting a convex curvature to the outside on all sides, is slid onto the projection **(1*a*) of a base (1). The casing (10) protects a contact device anchored in the base (1). The base (1) protrudes with the peripheral brackets (1*b*), formed on two sides of the base (1), beyond the projection (1*a*) into the casing (10) and supports the casing (10) from the insides A U-shaped carrier plate (4) is anchored with its arms (4*a*) in the brackets (1*b*). The carrier plate (4) is furnished with longitudinal edges (6), which are bent off at right angles outside of the anchoring, and the longitudinal edges (6) rest force-matchingly at the interior wall of the casing (10)**.

20 Claims, 2 Drawing Sheets

SWITCH PROTECTING AGAINST INCREASED TEMPERATURES

BACKGROUND OF THE INVENTION

1. Field of the Invention

The invention relates to a temperature protection switch for the protection of motor windings or the like against overheating, wherein a contact device, supported in a base made of an insulating material, is protected by a flat sleeve-shaped casing plugged onto the base.

2. Brief Description of the Background of the Invention Including Prior Art

Temperature protection switches of the above-recited kind are known. As compared to open temperature protection switches, structures of a closed type are always then employed, where the contact device requires protection relative to the pressure in the production of a winding, such as, for example, when pressure is applied at the end turn of an armature of a motor winding, or against environmental influences.

A known embodiment of an encapsulated temperature protection switch is the winding motor protector 9700 of the firm Texas Instruments Holland B.V. and Texas Instruments, Inc., Dallas, Tex., which can be employed as a temperature-dependent switch and/or a current dependent switch. The protecting casing and the contact device are constructed such that an adjustment of the switching element is still performable in the assembled state of the temperature monitors by bending the free end of the casing. Based on the kind of the switching element adjustment and the thereby required shape of the casing, this temperature protection switch is sensitive to the pressure from the outside. This kind of switch is therefore not optimized for employment in motor windinqs and transformer windings.

U.S. Pat. No. 3,431,526 to Ambler et al. teaches a miniature electrical switch. U.S. Pat. No. 3,747,208 to Rattan teaches a thermally responsive switch and a method to make such switch. U.S. Pat. No. 4,866,408 to Petraitis et al. teaches a multiphase motor protector apparatus. German Printed Patent Document teaches a temperature controller. None of these switches is furnished with a structure making it insensitive to outside pressure forces.

SUMMARY OF THE INVENTION

1. Purposes of the Invention

It is an object of the present invention to provide a temperature protection switch, which is particularly suitable for use in the construction of electric motors and transformers.

It is another object of the present invention to provide a temperature protection switch which allows a reliable switch protection against pressure influences and against environmental influences.

These and other objects and advantages of the present invention will become evident from the description which follows.

2. Brief Description of the Invention

The advantages obtained according to the present invention comprise in particular that the flat casing is stable against pressure based on its wall being convexly shaped on all sides toward the outside. The stability is further increased by the brackets of the base which are protruding shape-matchingly into the casing, and wherein the stiffening of the brackets is increased by the carrier plate embedded into the brackets.

According to the present invention, there is provided for a temperature protection switch for a protection of motor windings against overheating. A base is made of an insulating material. An overall flat casing has an interior wall and is slid like a sleeve onto the base. A contact device is mounted to the base and is protected by the overall flat casing. A wall of the casing surrounding the contact device, exhibits a convex curvature toward the outside on all sides. Two peripheral brackets are attached to two ends of the base, disposed inside the casing, and in part surrounding the contact device. The peripheral brackets, attached to two ends of the base, are matched to a curvature of the interior wall of the casing. The peripheral brackets rest shape-matchingly at the interior wall of the casing when the casing is plugged onto the base.

The casing can be made of a ferromagnetic material, of a deep-drawable material, or of a plastic material.

A projection can be furnished at the base for sliding the casing onto the base. The projection can match an inner profile of the casing. The projection can be furnished with a circumferential groove.

The circumferential groove can be a key bed, wherein the key bed can be disposed at a transition of the projection to the base.

The circumferential groove can be a flat groove for receiving a sealing ring. The flat groove can be disposed in a face of the projection.

A fixed contact can be anchored in the base. A U-shaped carrier plate having arms can be anchored with the arms in the peripheral brackets attached to the ends of the base. A tongue can protrude at a bottom of the U-shaped carrier plate. A thermal bimetal disk can support a counter contact. A trimming bow can support the thermal bimetal disk. The U-shaped carrier plate can be connected in a shape-matchingly and conducting way with the tongue protruding at the bottom of the U-shape to the thermal bimetal disk supporting the counter contact and to the trimming bow supporting the thermal bimetal disk.

The carrier plate can be furnished with outwardly bent-off longitudinal edges. The longitudinal edges are placed in a force-matching contact with the interior wall of the casing upon sliding the casing onto the base. A lower part of the bent-off longitudinal edges of the carrier plate can be furnished as outwardly adjustable tongues.

A projection can be furnished at the base for sliding the casing onto the base, wherein the projection matches an inner profile of the casing. A carrier can rest in the base. The carrier can be bent off at the face of the projection at a right angle like a Z, and the carrier can be bent off a second time in opposite direction to now project from the projection to an inside of the casing and supporting the contact disposed in a fixed position.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
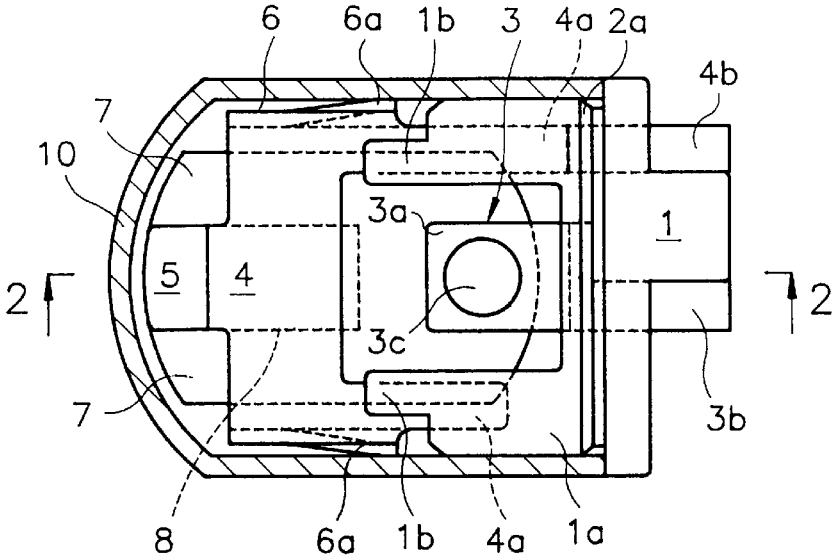
FIG. 1 is a top plan view of a temperature protection switch, where the upper half of the casing has been removed.

According to the present invention, there is provided for a temperature protection switch for a protection of motor windings against overheating. A contact device, supported in a base made of an insulating material, is protected by a flat casing, slid like a sleeve onto the base. A wall of the casing 10, surrounding the contact device, exhibits a convex curvature toward the outside on all sides. The base 1 is furnished on its sides with peripheral brackets 1*b* reaching approximately to a center of the contact device. The peripheral brackets 1*b*, disposed on two sides of the base 1, are matched to the convex curvature of the wall of the casing. The peripheral brackets 1*b* rest shape-matchingly at an interior wall of the casing 10 when the casing 10 is plugged onto the base 1.

The casing 10 can be made of a ferromagnetic material, of a deep-drawable material, or of a plastic material.

The base 1 can be furnished with a projection 1*a* for sliding the casing 10 onto the base 1. The projection 1*a* can match an inner profile of the casing 10 and the projection 1*a* can be furnished with a circumferential groove. The circumferential groove can be a key bed 2*a*, wherein the key bed 2*a* can be disposed at a transition of the projection 1*a* to the base 1. The circumferential groove can be a flat groove 2*b* for receiving a sealing ring 9, and the flat groove 2*b* can be disposed in a face of the projection 1*a*.

The contact device can be furnished with a fixed contact 3 anchored in the base 1 and with a carrier plate 4. The carrier plate 4 can be connected in a shape-matchingly and conducting way with an end-positioned tongue 5 to a thermal bimetal disk 7 with a counter contact 7*a* and to a trimming bow 8. The carrier plate 4 can be formed like a U shape and can be anchored with its arms 4*a* in the peripheral brackets 1*b* disposed on two sides of the base 1. The carrier plate 4 can be furnished with longitudinal edges 6, angled outside of the anchoring. The longitudinal edges 6 can be placed in a force-matching contact to the interior wall of the casing 10 upon sliding of the casing 10 onto the base 1 A lower part of the bent-off longitudinal edges 6 can be furnished as outwardly adjustable tongues 6*a*.

A carrier 3*a* of the fixed contact 3 can be bent off at right angles like a Z as seen in a direction parallel relative to the plane of the contacts 3*c* and 7*a*.

Figure 2:
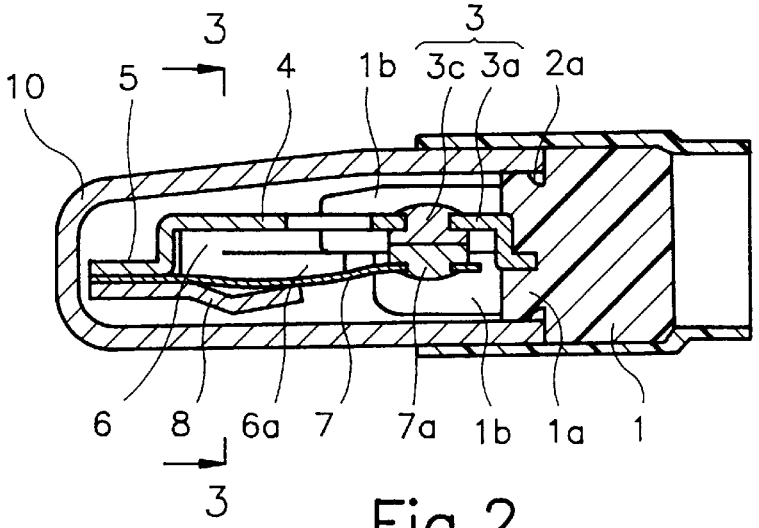
FIG. 2 is a sectional view of the temperature protection switch according to FIG. 1, along section line 2—2 of FIG. 1.

In accordance with the present invention, there is shown in FIG. 1 a temperature protection switch in a top plan view, wherein the upper half of a casing 10 has been removed to allow a view inside of the casing 10. The base 1 will support the electrical elements contained in the temperature protection switch. The casing 10 is slid onto a projection 1*a* of a base 1. The opening of the casing 10 and the base 1 exhibit in general an oblong shape as seen in FIGS. 1 and 2. The electrical elements contained in the temperature protection switch are then enclosed by the base 1 and the slid onto the casing 10, wherein the casing 10 also covers the projection 1*a* of the base 1. The base 1 is made of an insulating material. The view of FIG. 1 allows to look freely into the interior of the casing 10, which surrounds substantially a contact device 3*c*, 7*a* responding to thermal changes. The casing 10 shows a length extending from the projection 1*a* of the base 1 which is from about 1 to 1.4 times the width of the casing 10. A vertical thickness of the casing 10, as seen for example in FIG. 2, can be from about 0.04 to 0.6 times the width of the casing 10. The casing 10 exhibits a closed end opposite to the open end slit onto the projection 1*a* of the base 1. The closed end as seen from above is shaped like a convex circular section, wherein the radius of curvature is from about 0.04 to 0.6 times the length of the casing 10. The contact device includes contact 3 located in a fixed position and a U-shaped carrier plate 4. The carrier plate 4 is shape-matchingly and conductingly connected with a tongue 5 to a thermal bimetal disk 7 and to a trimming bow 8. The tongue 5 and the trimming bow 8 can have a width of from about 0.8 to 1.2 times the width of the carrier 3*a*. The trimming bow 8 is attached to the tongue 5 from below and extends substantially parallel to the U-shaped carrier plate 4 to a level corresponding to the inner cut-out of the U shape. The tongue 5 is attached at the bottom of the U shape. The tongue 5 extends in a plane substantially parallel to the plane of the U-shaped carrier plate 4. A web is furnished between the bottom of the U shape and the tongue 5 extending perpendicular to the plane of the U-shaped carrier plate 4 and gives a step between the tongue 5 and the plane of the U-shaped carrier plate 4. The contact 3, furnished in a fixed position, is surrounded by arms 4*a* of the U-shaped carrier plate 4. The U-shaped carrier plate 4 is disposed in the casing such that the bottom of the U-shaped carrier plate 4 is close to the closed end of the casing 10 and such that the arms of the U extend substantially parallel to the slide-on direction of the casing 10. The flat plane of the U-shaped carrier plate 4 is disposed substantially parallel to the flat plane of the casing 10. The contact 3, located in a fixed position, comprises a carrier 3*a* furnished with a contact 3*c*, wherein the carrier 3*a* is anchored in the base 1, and wherein the carrier 3*a* forms a single part together with a first connector 3*b*, accessible from the outside. The single part of the carrier 3*a* and of the first connector 3*b* can be in part molded into the base 1. The connector 3*b* protrudes from the base 1 to the outside for making external contact to the temperature protection switch. A bracket 1*b* is disposed on the sides of the base 1 forming a continuation of the projection 1*a*. The brackets 1*b* are disposed near the ends of the oblong shape of the base 1 and extend in the slide-on direction of the casing 10 on the base 1. The U-shaped carrier plate 4 is anchored with the arms 4*a* in the bracket 1*b*, as shown in FIG. 1 by the dashed lines, and where the arms 4*a* are formed based on the U-shape of the carrier plate 4. One of the arms 4*a* of the U-shaped carrier plate 4 is led through the base 1 and forms a single part with a second connector 4*b* also accessible, like the first connector 3*b*, from the outside.

FIG. 2 shows the temperature protection switch of FIG. 1 in a sectional view 2—2. As this representation allows to gather, the U-shaped carrier plate 4 is bent off at right angles and in steps relative to the tongue 5. The thermal bimetal disk 7 connected to the tongue 5 is furnished at a free end with a counter contact 7*a* directed toward the contact 3*c* of the contact 3 in the fixed position. Based on the trimming bow 8, resting from below at the thermal bimetal disk 7, the contact pressure between the contact 3*c* and the contact 7*a* is adjusted in a conventional way such that the thermal bimetal disk 7, upon heating to a predetermined temperature, reacts by a jump and thereby separates the two contacts 3*c* and 7*a*. The thermal bimetal disk 7 preferably extends in its width to an area close to the bracket 1*b* without touching the bracket 1*b* . Thus, the width of the thermal bimetal plate can be from about 0.5 to 0.8 times the width of the casing 10 and is preferably from about 0.6 to 0.7 times the width of the casing. The length of the thermal bimetal plate 7 can be nearly the length of the free open space in the casing 10 as bordered by the base projection 1*a*. Preferably, the thermal bimetal plate follows the inner contour of the casing in the areas where the casing provides the outer border of the temperature protection switch as shown in FIG. 1. The contact 7*a* is disposed below the contact 3*c* and attached to the thermal bimetal plate 7. Depending on the height level of the strength of the current to be switched, there is formed during the opening process a more or less strong electric arc between the contacts 3*c* and 7*a*. The carrier 3*a* , according to FIG. 2, is bent off at right angles like a Z shape such that the projection 1*a* is protected in the contact plane of the two contacts 3*c* and 7*a* over the width of the carrier 3*a*, against the heat generated by the electric arc for the protection of the front face of the base projection 1*a*. For example, a base 1 made of a plastic material can be damaged to such an extent by the heat impact that parts are gasified, which are then deposited on the contact faces and result in interferences with the functioning and operation.

Figure 3:
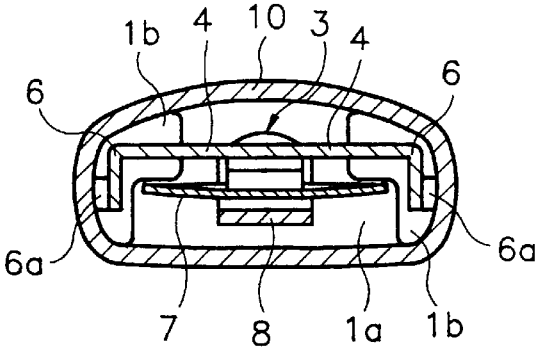
FIG. 3 is a sectional view of the temperature protection switch according to FIG. 1, along section line 3—3 of FIG. 2.

FIG. 3 shows the temperature protection switch according to FIG. 1 in a sectional view 3—3 of FIG. 2. This cross-section shows the casing 10, where the wall of the casing 10 is curved convex toward the outside on all sides. According to FIG. 1, the front face has also a convex curvature as seen from the outside. This feature and a stiffening from the inside, which is still to be described, result in an extraordinarily pressure-stable casing 10, which can withstand a high pressure during the production of the winding, for example, upon overwinding of the mounted temperature protection switch or when pressure is exerted on the winding. The stiffening of the interior of the casing 10 is performed by the already recited bracket 1*b* of the base 1. These brackets 1*b* are, as the projection 1*a* of the base itself, adapted to the interior profile of the casing 10 and rest force-matchingly at the interior wall of the casing 10. The U-shaped carrier plate 4, formed as a rigid connection and anchored with its arms 4*a* in the brackets 1*b*, prevents that the brackets 1*b* yield upon pressure from the outside. The support plate 4 is furnished, according to FIG. 3, with longitudinal edges 6 which are offset by 90 by degrees at the outside of the anchoring. The longitudinal edges 6 extend in a direction parallel to the arms of the U and project perpendicular to the plane of the U in a downward direction toward the position of the thermal bimetal disk 7. These longitudinal edges 6 can be slightly spread and expanded toward the outside so that they rest force-matchingly at the interior wall of the casing 10 when the casing is slid onto the base 1 FIGS. 1, 2 and 3 show an alternative, wherein the lower part of the longitudinal edges 6 are formed as tongues 6*a* adjustable toward the outside. These tongues 6*a* then rest force-matchingly at the interior wall of the casing 10. In addition to the stiffening effect, the preferably face-like contact between the carrier plate 4 and the casing 10 is associated with the advantage that, in addition to the current-dependent monitoring, also temperature influences from the outside can be passed to and can activate the thermal bimetal disk 7 through the casing 10 and the U-shaped carrier plate 4.

The convexly curved cross-sectional shapes of the base projection 1*a* and of the casing 10 as seen from the outside allow by themselves already a substantial sealing effect. The requirements as to the sealability can further make additional steps necessary in cases where the temperature protection switch is employed in situations where the windings are cast under low pressure in impregnating varnish.

FIG. 2 shows a possibility of an additional encapsulation. The projection 1*a* is furnished with a wedge-shaped groove or a key bed 2*a* at the transition to the base 1. The edge of the slid-on casing 10 is bent over into the wedge-shaped groove or the key bed 2*a*. A piece of a shrinking tube 11 is then pulled over the seam line.

Figure 4:
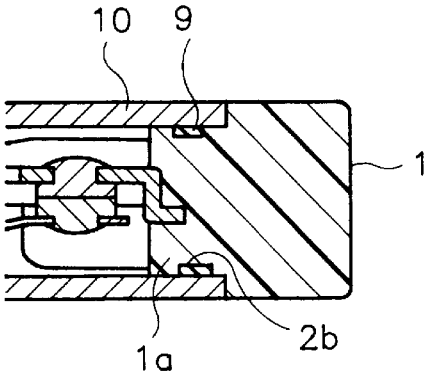
FIG. 4 is a sectional view of a detail of the temperature protection switch according to FIG. 2, with a variation of the base structure.

FIG. 4 shows a further possibility of additional sealing. In distinction to the example of FIGS. 1 through 3, in this case, the projection 1*a* of the base 1 is furnished approximately in the middle of the face with a flat groove 2*b*, where said face refers to the area of overlap between the casing 10 and the projection 1*a*. A slightly protruding sealing ring 9 is inserted into the flat groove 2*b*, or the groove 2*b* is filled with an elastic plastic material during the production of the base 1 in a two-component injection molding process, wherein the elastic plastic material protrudes slightly convex to the outside.

Figure 5:
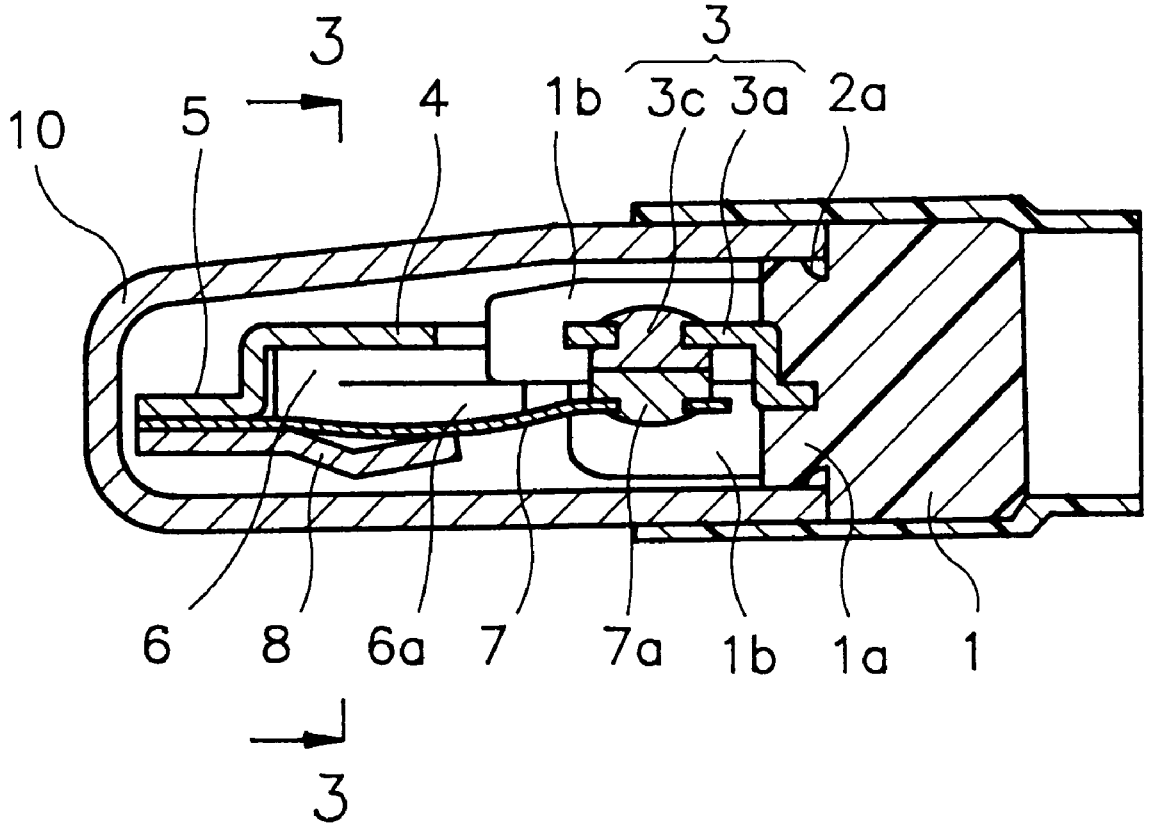
FIG. 5 is a sectional view of the temperature protection switch according to FIG. 1 with certain modifications, along section line 2—2 of FIG. 1.

As shown in FIG. 2, the bracket 1*b* can be subdivided at the level of the U-shaped plate 4 and the arms of the U-shaped plate 4 are visible at least in part through a recess in the bracket 1*b*. An alternative construction is shown in FIG. 5, where the arms of the U-shaped plate 4 are not visible from the side, but where the arms of the U-shaped plate 4 are held in the bracket 1*b*.

Depending on the field of application, the casing 10 can be formed of different materials. Ferromagnetic materials, such as steel or Mu-metal, protect the contact device from magnetic blow fields. In case of a high field strength, the magnetic blow fields can deflect the electric arc, formed upon opening of the contacts, to such an extent that the electric arc jumps over onto the thermal bimetal disk 7. The jumping over destroys the thermal bimetal disk. If it is desired only to protect the contact device from a soiling, then the casing 10 can be made of deep-drawable material, such as tombac, cock metal, or of a plastic.

It will be understood that each of the elements described above, or two or more together, may also find a useful application in other types of protection switches differing from the types described above.

While the invention has been illustrated and described as embodied in the context of a temperature protection switch with an overall flat casing with convex outer contours, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic or specific aspects of this invention.

What is claimed as new and desired to be protected by Letters Patent is set forth in the appended claims:

1. A temperature protection switch for a protection of motor windings against overheating comprising a base made of an insulating material and having a first side and a second side;

an overall flat casing having an interior wall and slid like a sleeve onto the base;

a contact device mounted to the base and protected by the overall flat casing;

wall of the casing, surrounding the contact device and exhibiting a convex curvature toward the outside on all sides;

a first peripheral bracket furnished at the first side and a second peripheral bracket furnished at the second side of the base, disposed inside the casings and in part surrounding the contact device, wherein the first peripheral bracket and the second peripheral bracket, are matched to a curvature of the interior wall of the casing, and wherein the first peripheral bracket and the second peripheral bracket rest shape-matchingly at the interior wall of the casing when the casing is plugged onto the base.

2. The temperature protection switch according to claim 1, wherein the casing is made of a ferromagnetic material.

3. The temperature protection switch according to claim 1, wherein the casing is made of a deep-drawable material.

4. The temperature protection switch according to claim 1, wherein the casing is made of a plastic material.

5. A temperature protection switch for a protection of motor windings against overheating comprising a base made of an insulating material and having a first side and a second side;

an overall flat casing having an interior wall and slid like a sleeve onto the base;

a contact device mounted to the base and protected by the overall flat casing, and wherein a wall of the casing, surrounding the contact device, exhibits a convex curvature toward the outside on all sides;

a first peripheral bracket furnished at the first side of the base and a second peripheral bracket furnished at the second side of the base, disposed inside the casing, and in part surrounding the contact devices wherein the first peripheral bracket and the second peripheral bracket are matched to a curvature of the interior wall of the casing, and wherein the first peripheral bracket and the second peripheral bracket rest shape-matchingly at the interior wall of the casing when the casing is plugged onto the base; and a projection furnished at the base for sliding the casing onto the base, wherein the projection matches an inner profile of the casing, and wherein the projection is furnished with a circumferential groove.

6. The temperature protection switch according to claim 5, wherein the circumferential groove is a key bed, wherein the key bed is disposed at a transition of the projection to the base.

7. The temperature protection switch according to claim 5, wherein the circumferential groove is a flat groove for receiving a sealing ring, and wherein the flat groove is disposed in a face of the projection.

8. A temperature protection switch for a protection of motor windings against overheating comprising a base made of an insulating material and having a first side and a second side;

an overall flat casing having an interior wall and slid like a sleeve onto the base;

a contact device mounted to the base and protected by the overall flat casing;

a wall of the casing, surrounding the contact device and exhibiting a convex curvature toward the outside on all sides;

a first peripheral bracket furnished at the first side of the base and a second peripheral bracket furnished at the second side of the base, disposed inside the casing, and in part surrounding the contact device, wherein the first peripheral bracket and the second peripheral bracket are matched to a curvature of the interior wall of the casing, and wherein the first peripheral bracket and the second peripheral bracket rest shape-matchingly at the interior wall of the casing when the casing is plugged onto the base; a fixed contact anchored in the base;

a U-shaped carrier plate having arms, wherein the carrier plate is anchored with the arms in the first peripheral bracket furnished at the first side of the base and the second peripheral bracket furnished at the second side of the base;

a tongue protruding at a bottom of the U-shaped carrier plate;

a thermal bimetal disk supporting a counter contact;

a trimming bow supporting the thermal bimetal disk, wherein the U-shaped carrier plate is connected in a shape-matchingly and conducting way with the tongue protruding at the bottom of the U-shape to the thermal bimetal disk supporting the counter contact and to the trimming bow supporting the thermal bimetal disk.

9. The temperature protection switch according to claim 8, wherein the carrier plate is furnished with outwardly bent-off longitudinal edges, wherein the longitudinal edges are placed in a force-matching contact with the interior wall of the casing upon sliding the casing onto the base; wherein a lower part of the bent-off longitudinal edges of the carrier plate is furnished as outwardly adjustable tongues.

10. The temperature protection switch according to claim 8, further comprising a projection furnished at the base for sliding the casing onto the base, wherein the projection matches an inner profile of the casing;

a carrier resting in the base, wherein the carrier is bent off at the face of the projection at a right angle like a Z, and wherein the carrier is bent off a second time in opposite direction to now project from the projection to an inside of the casing and supporting the contact disposed in a fixed position.

11. A temperature protection switch for a protection of motor windings against overheating, wherein a contact device, supported in a base made of an insulating material, is protected by a flat casing, slid like a sleeve onto the base, wherein a wall of the casing (10), surrounding the contact device, exhibits a convex curvature toward the outside on all sides, wherein the base (1) is furnished on its sides with peripheral brackets **(1*b*) reaching approximately to a center of the contact device, wherein the peripheral brackets (1*b*), disposed on two sides of the base (1), are matched to the convex curvature of the wall of the casing, and wherein the peripheral brackets (1*b*) rest shape-matchingly at an interior wall of the casing (10) when the casing (10) is plugged onto the base (1)**.

12. The temperature protection switch according to claim 11, wherein the casing (10) is made of a ferromagnetic material.

13. The temperature protection switch according to claim 11, wherein the casing (10) is made of a deep-drawable material.

14. The temperature protection switch according to claim 11, wherein the casing (10) is made of a plastic material.

15. A temperature protection switch for a protection of motor windings against overheating, wherein a contact device, supported in a base made of an insulating material, is protected by a flat casing, slid like a sleeve onto the base, wherein a wall of the casing (10), surrounding the contact device, exhibits a convex curvature toward the outside on all sides, wherein the base (1) is furnished on its sides with peripheral brackets (1*b*) reaching approximately to a center of the contact device, wherein the peripheral brackets (1*b*), disposed on two sides of the base (1), are matched to the convex curvature of the wall of the casing, and wherein the peripheral brackets (1*b*) rest shape-matchingly at an interior wall of the casing (10) when the casing (10) is plugged onto the base (1) and wherein the base (1) is furnished with a projection (1*a*) for sliding the casing (10) onto the base (1), wherein the projection (1*a*) matches an inner profile of the casing (10), and wherein the projection (1*a*) is furnished with a circumferential groove.

16. The temperature protection switch according to claim 15, wherein the circumferential groove is a key bed (2*a*) wherein the key bed (2*a*) is disposed at a transition of the projection (1*a*) to the base (1).

17. The temperature protection switch according to claim 15, wherein the circumferential groove is a flat groove (2*b*) for receiving a sealing ring (9), and wherein the flat groove (2*b*) is disposed in a face of the projection (1*a*).

18. A temperature protection switch for a protection of motor windings against overheating, wherein a contact device, supported in a base made of an insulating material, is protected by a flat casing, slid like a sleeve onto the base, wherein a wall of the casing (10), surrounding the contact device, exhibits a convex curvature toward the outside on all sides, wherein the base (1) is furnished on its sides with peripheral brackets (1*b*) reaching approximately to a center of the contact device, wherein the peripheral brackets (1*b*), disposed on two sides of the base (1), are matched to the convex curvature of the wall of the casing, and wherein the peripheral brackets (1*b*) rest shape-matchingly at an interior wall of the casing (10) when the casing (10) is plugged onto the base (1);

wherein the contact device is furnished with a fixed contact (3) anchored in the base (1) and with a carrier plate (4), wherein the carrier plate (4) is connected in a shape-matchingly and conducting way with an end-positioned tongue (5) to a thermal bimetal disk (7) with a counter contact (7*a*) and to a trimming bow (8) wherein the carrier plate (4) is formed like a U shape and is anchored with its arms (4*a*) in the peripheral brackets (1*b*) disposed on two sides of the base (1).

19. The temperature protection switch according to claim 18, wherein the carrier plate (4) is furnished with longitudinal edges (6), angled outside of the anchoring, wherein the longitudinal edges (6) are placed in a force-matching contact to the interior wall of the casing (10) upon sliding of the casing (10) onto the base (1), wherein a lower part of the bent-off longitudinal edges (6) is furnished as outwardly adjustable tongues (6*a*).

20. The temperature protection switch according to claim 18, wherein a carrier (3*a*) of the fixed contact (3) is bent off at right angles like a Z as seen in a direction parallel relative to the plane of the contacts (3*c* and 7*a*).

* * * * *